US008142172B2

(12) United States Patent
Förster

(10) Patent No.: US 8,142,172 B2
(45) Date of Patent: Mar. 27, 2012

(54) SILENCER DESIGNED AND INTENDED FOR A COMPRESSOR

(75) Inventor: Andreas Förster, Dörfles-Esbach (DE)

(73) Assignee: Kaeser Kompressoren GmbH, Coburg (DE)

( * ) Notice: Subject to any disclaimer, the term of this patent is extended or adjusted under 35 U.S.C. 154(b) by 1315 days.

(21) Appl. No.: 11/407,892

(22) Filed: Apr. 21, 2006

(65) Prior Publication Data

US 2006/0239836 A1 Oct. 26, 2006

(30) Foreign Application Priority Data

Apr. 22, 2005 (EP) ..... 05008836
Mar. 13, 2006 (EP) ..... 06005095

(51) Int. Cl.
*F04B 39/00* (2006.01)

(52) U.S. Cl. ..... 417/312; 181/403

(58) Field of Classification Search ..... 181/250, 181/266, 273, 276, 251, 253, 257, 268, 275, 181/403; 417/312, 540–544
See application file for complete search history.

(56) References Cited

U.S. PATENT DOCUMENTS

| | | | | |
|---|---|---|---|---|
| 2,990,907 | A * | 7/1961 | Everett | 181/256 |
| 4,162,904 | A * | 7/1979 | Clay et al. | 96/381 |
| 5,101,931 | A | 4/1992 | Blass et al. | |
| 5,451,727 | A * | 9/1995 | Park | 181/229 |
| 5,938,411 | A * | 8/1999 | Seo | 417/312 |
| 5,971,720 | A * | 10/1999 | Fagotti et al. | 417/312 |
| 6,012,908 | A * | 1/2000 | Tanaka et al. | 417/312 |
| 6,129,522 | A * | 10/2000 | Seo | 417/312 |
| 6,149,402 | A * | 11/2000 | Kim | 417/312 |
| 6,152,703 | A * | 11/2000 | Yoshimura et al. | 417/312 |
| 6,206,655 | B1 * | 3/2001 | Tanaka et al. | 417/312 |
| 6,547,032 | B2 * | 4/2003 | Yoon et al. | 181/229 |
| 7,435,060 | B2 * | 10/2008 | Kim et al. | 417/312 |
| 2006/0018778 | A1 * | 1/2006 | Seo | 417/540 |

FOREIGN PATENT DOCUMENTS

| | | |
|---|---|---|
| DE | 3509362 | * 11/1985 |
| FR | 2 498 681 A | 7/1982 |
| JP | H08-028479 | 1/1996 |
| JP | 2005-009458 | 1/2005 |

* cited by examiner

*Primary Examiner* — Devon C Kramer
*Assistant Examiner* — Bryan Lettman
(74) *Attorney, Agent, or Firm* — Jean C. Edwards, Esq.; Edwards Neils PLLC

(57) ABSTRACT

A silencer operative for a compressor or a vacuum pump, in particular for a compressor or a vacuum pump that operate according to the displacement principle, which in either case compresses a current of gas, in particular an air current, such that the silencer includes an entrance for the gas current that leaves the compressor, as well as an exit, the silencer including a branching region having an inflow channel which branches into two channel sections, such that a first channel section is constructed as a main conduit to conduct the gas current further, and a second channel section forms a branch that is closed at its end. The branch has an axial preferential direction oriented parallel to the direction of flow of the gas current in the inflow channel, so that the gas current impinges frontally on the branch that is closed at its end.

23 Claims, 4 Drawing Sheets

SILENCER DESIGNED AND INTENDED FOR A COMPRESSOR

CROSS-REFERENCE TO RELATED APPLICATIONS

The present application claims priority from European Patent Applications Nos. 05 008836.8, filed Apr. 22, 2005, and 06 005095.2, filed on Mar. 13, 2006, the contents of which are herein incorporated by reference in their entirety.

BACKGROUND OF THE INVENTION

1. Field of the Invention

The invention relates to a silencer designed and intended for a compressor or a vacuum pump, in particular for a compressor that operates according to the displacement principle, or for a vacuum pump that operates according to the displacement principle, which in either case compresses a current of gas, in particular an air current, such that the silencer includes an entrance for the gas current that leaves the compressor, as well as an exit. Within the silencer there is provided a branching region at which an inflow channel divides into two channel sections, namely a first channel section constructed as a main conduit to conduct the gas current further, and a second channel section forming a branch that is closed at its end. The invention further relates to a compressor equipped with such a silencer, as well as to a method of reducing pulsations in a gas current generated by a compressor.

2. Description of the Related Art

A silencer with the characteristics described above is already known from the patent EP 0 542 169 B1. In general, compressors, in particular those that operate according to the displacement principle (e.g., screw-type compressors, Roots blowers), present the problem that because the expulsion process on the pressurized or expulsion side of the compressor is discontinuous, pulsations arise in the downstream components, such as pipelines, coolers, containers etc., and these in turn give rise to two main problems, descriptions of which follow.

First, the attached components are placed under considerable stress by the change in pressure, which can cause damage to their material owing to fatigue (permanent fractures, etc.) caused by the cyclic loading produced by the primary pressure change and/or the associated oscillations.

Second, the considerable noise emission resulting from the pressure change also as a consequence of the initiation, conduction and radiation of structure-borne sound, proves to be extremely disadvantageous. These problems are especially severe in the case of screw compressors that operate under dry conditions, so that pulsations that may be quite large are produced at the exit from the compression stages. Because the expulsion processes are not harmonic in nature, i.e., sinusoidal or cosinusoidal, but rather are impulse-like, the harmonics of the basic frequency are also emphasized in the frequency analysis, in some cases even more strongly than the basic frequency.

The pulsations with an amplitude relevant here are as a rule within a broad frequency range, typically 200 Hz to 10 kHz. Because of the tonal character of the pulsation (main expulsion frequency and its harmonics) the noises thus produced are subjectively unpleasant.

The main expulsion frequencies can vary widely within a compressor series composed substantially of identical components, on account of various influences. For one thing, the output is often adjusted by regulating the speed of rotation, for instance by means of a frequency converter. Furthermore, individual compressors are often delivered with differently constructed gear trains to drive the compressor stages, in order to adjust the power/pressure. Finally, within a compressor series some individual compressors operate while connected to 50-Hz electrical networks, and others are connected to 60-Hz networks.

Sound-damping procedures effective within a narrow band, with slight dissipation, are not well suited to operate under the limiting conditions described above, because either a plurality of differently tuned silencers are needed for a single compressor, in order to achieve a certain broad-band action, or several silencer variants must be supplied, which are then matched to the individual compressor variants or their later application circumstances. However, this is possible only if the compressor involved is not one having variable frequency (e.g., rotation-speed regulation).

SUMMARY OF THE INVENTION

It is the objective of the present invention to propose an especially effective, in particular also broadband, silencer for a compressor or a vacuum pump as well as a method of reducing pulsations in a gas current generated by a compressor or a vacuum pump.

This objective is achieved with regard to the technology of the apparatus by a silencer having the characteristics such as an entrance for the gas current that leaves the compressor and an exit, and such that within the silencer there is provided a branching region that includes an inflow channel from which two channel sections branch away, such that a first channel section is constructed as a main conduit to conduct the gas current further, and a second channel section forms a branch that is closed at its end, wherein the branch has an axial preferential direction (A) oriented parallel to the direction of flow of the gas current in the inflow channel, so that the gas current impinges at least substantially frontally against the branch that is closed at its end.

Further, this objective is achieved with regard to the technology of the apparatus by a silencer having the characteristics, and regarding the procedural technology by the characteristics of reducing pulsations in a gas current generated by a compressor or vacuum pump, in particular one that operates according to the displacement principle, such as for instance a screw-type compressor or a screw-type vacuum pump, wherein the gas current is guided through an entrance into the silencer and out of the latter by way of an exit, such that inside the silencer a branching region is provided that includes an inflow channel from which two channel sections branch off, such that a first channel section is constructed as a main conduit to guide the gas current further, and a second channel section is constructed as a branch closed at its end, wherein a counter-impingement by way of a reflective and/or resonant acoustic behaviour in the branch, which is oriented with an axial preferential direction (A) parallel to the direction of flow of the gas current in the inflow channel, is produced and utilized in order to reduce the pulsation in the gas current.

In addition a compressor or a vacuum pump is disclosed that is equipped with a silencer in accordance with the invention. Advantageous further developments are disclosed in the following description.

A central idea underlying the present invention is that the branching section includes an axial preferential direction (A) oriented parallel to the direction of flow of the gas current in the inflow channel, so that the gas current encounters substantially frontally the branch that is closed at its end. The invention is thus based on the consideration that the sound-related alternating flow in the gas current is especially well damped when a branch closed at its end is directed into the main stream of flowing gas in such a way that the gas current impinges frontally on the branch.

In an advantageous further development, the main conduit, which conducts the gas current further, is so constructed and/or oriented that the gas current emerges from the branching region in a direction transverse to that of the gas current in the inflow channel. The term "main conduit" here is meant to include every configuration of a current conduit, such as in particular a 360° annular passageway, or part of an annular passageway covering less than 360°, in particular also branching-off tube with a circular or polygonal cross section, etc.

In another preferred embodiment the branch and the inflow channel are oriented coaxially or at least substantially coaxially with respect to one another, i.e., the projections of their cross sections are not appreciably offset, but rather are substantially concentric.

Especially good sound-damping properties have been obtained when a cover element provided with openings, in particular a perforated plate, is disposed at or in the branch so as to cover the internal cross section of the branch. In this arrangement part of the sound-related alternating flow can enter through the openings in the region of the branch closed off by the cover element. It must be assumed that the good sound-damping properties are based on a superposition of reflection-related, resonance-related and dissipative effects.

In one embodiment the branch can be subdivided by interior walls to form sub-volumes, each of which is associated with a particular number of openings and a corresponding section of the cover element, and which act as largely independent damping elements, in particular as independent resonators, with different resonant frequencies. The distance to which these sub-volumes extend in the direction of the gas flow within the inflow channel can also vary, in order to obtain different reflection properties.

In another preferred embodiment it is possible to make fine adjustments of the damping behaviour of the silencer by way of the arrangement and/or size and/or shape and/or number of the openings in the cover element or the thickness of the cover element, in particular while taking into account the resonator volume or the resonator sub-volumes. In particular, this measure can be used to adjust both resonant frequencies and also broadband characteristics of the silencer.

The parameters of the openings are chosen such that while the silencer is in operation, because of the gas volumes being pumped back and forth through the openings appreciable dissipative effects are produced, which endow the silencer with the desired broadband characteristic. The arrangement of the openings in the cover element of the branch, which is disposed at a small distance from the inflow opening, preferably less than $\lambda/10$ ($\lambda$ designates the wavelength of the frequency to be preferentially damped, in particular a main expulsion frequency of the compressor apparatus or of the vacuum pump in a preferred operating range), and substantially parallel to the inflow cross section, results in a high acoustic admittance of the branch despite superposition of the gas flow, which is advantageous for the damping action of the branch.

The main dimension of a housing that encloses the branch in the direction of its cylinder long axis preferably amounts to $\lambda/4$ of the main expulsion frequency of the compressor apparatus.

Preferably within the entire flow path there are no flat walls next to one another that are arranged in parallel at a distance of $\lambda/2$ or an odd multiple thereof, or are connected by flow channels having a length of $\lambda/2$ or an odd multiple thereof and close off these channels vertically; this measure avoids the formation of standing waves at the main expulsion frequency of the compressor apparatus.

The arrangement of the exit channel as part of the main conduit, which continues onward, is preferably such that a chamber wall of the branch that is next to the exit cross section is positioned at a flat angle (but definitely not perpendicular) to the long axis of the exit channel, so that no reflective planes for standing waves are formed in pipelines connected thereto. The exit channel is thus preferably arranged tangentially or axially with respect to the chamber wall of the branch.

Preferably the long axis of the branch is eccentric with respect to the long axis of the housing, the distance between the axes being chosen such that the cross section of an annular space between branch and housing increases in the direction towards the exit.

In principle there are two conceivable alternative ways of disposing the cover element, preferably so that it is substantially orthogonal to the preferential direction of the branch. According to a first alternative embodiment the cover element is disposed at the end of the branch that faces towards the inflow channel, and in a second alternative, and in principle preferred embodiment, the cover element is inserted into the branch at its end away from the inflow channel.

Preferably the branch is constructed as a resonator chamber, i.e., the sound-damping behaviour of the branch is based at least partly on the fact that the branch acts as a Helmholtz resonator, preferably being tuned to the main expulsion frequency. In the case of a resonator chamber subdivided into multiple sub-volumes, the sub-volumes and the associated sections of the cover elements and the openings therein can be tuned to several different resonant frequencies, preferably the main expulsion frequency and/or its harmonics.

According to another preferred aspect of the present invention the branch functions at least partly (also) as $\lambda$/quarter pipe.

According to another preferred aspect of the present invention the branching region additionally incorporates, in particular downstream of the branch, at least one constriction through which the gas current must pass. The constriction in this case provides a stepwise impedance change, and thus, can further decisively improve the sound-damping properties of the silencer in accordance with the invention.

Preferably the constriction is formed in the main conduit, which is turned away so as to be perpendicular to the inflow channel. The silencer with the branching region in accordance with the invention can be accommodated in a housing shaped substantially as a flattened cylinder, with two end surfaces between which a jacket surface is disposed, the entrance opening being disposed at a first end surface and the exit opening at the jacket surface. The result is an especially compact and at the same time robust silencer, in which the branching region constructed according to the invention can be particularly well implemented.

In another preferred embodiment the branch includes a pot-shaped basic body, or is formed by a pot-shaped basic body. Particularly preferred in this case is an embodiment in which the second end surface of the housing is formed by an end plate of the pot-shaped basic body, the housing itself preferably having the shape of a flattened cylinder.

The silencer in an optional embodiment can further include, downstream of the branch, an auxiliary sound damper or an additional sound-absorption means that at least partially encloses the branch, preferably so that an annular space is formed between them. According to this consideration, there is inserted after the branch an auxiliary sound damper that preferably is accommodated within the same housing, so that a compact and functional unit is produced. The auxiliary sound damper or the additional sound-absorption means can preferably be designed primarily as an absorption sound damper.

In a preferred further embodiment the auxiliary sound-absorption means surrounds the branch completely, preferably circularly, and also preferably substantially concentrically. In a possible, preferred embodiment the annular space has two ends positioned opposite one another, such that the second end includes one or more openings through which the gas current is guided to the exit. This arrangement ensures that the gas current flows through the entire length of the auxiliary sound damper or the additional sound-absorption means, so that especially good sound-damping results are achieved.

The annular space can include, in particular, a radial expansion, so that an absorption silencer with good damping properties is implemented. Preferably the radial expansion of the annular space is covered by a cover, through which currents can flow, which in particular acts as a flow resistor.

Preferably, but not necessarily, the auxiliary sound damper or the additional sound-absorption means is tuned to another frequency, preferably to a higher frequency, than the components of the silencer upstream of the additional sound-absorption means, so that in combination the effect is as broadband as possible.

Experiments with the silencer constructed in accordance with the invention have shown that the sound-related alternating flow of the gas current is decidedly reduced not only in the silencer and/or on the downstream side of the silencer, but that this reduction of the sound-related alternating flow also applies upstream of the silencer, as far as the compressor. To make such an action in the reverse direction as effective as possible, the silencer should be attached to the outlet of the compressor or vacuum pump either directly or by means of a tubular section that is adequately short. Accordingly, what is also claimed as belonging to the invention includes a compressor or a vacuum pump, in particular a compressor that operates according to the displacement principle or a vacuum pump that operates according to the displacement principle, such as for example a screw-type compressor or screw-type vacuum pump, including a compression chamber as well as an outlet and, attached thereto, a silencer in accordance with the invention.

The fact that the silencer also has a pronounced action in the reverse direction, i.e., on the sound-related alternating flow in the outlet of the compressor or the vacuum pump itself, can be explained as follows. The compressor, i.e., the compressing stage of the compressor or vacuum pump, is intuitively but erroneously regarded as an unbearable pulsation source, so that the "reverse-action effect" at first seems surprising. However, the pulsation source "compressing stage" does not impose any unalterable pressure-variation signal on the entrance to the silencer. Instead, because of its expulsion kinematics, the compressing stage represents a "sound-velocity source" (for example: a movable wall, a cyclically moved piston within a tube, etc.). The time course of pressure at the outlet of the compressing stage, i.e., of the compressor or vacuum pump, can thus readily be positively influenced by a suitable silencer, i.e., its amplitude can be reduced.

Also claimed, according to a further aspect of the present invention, is a method of reducing pulsations in a gas current produced by a compressor or vacuum pump, in particular one that operates according to the displacement principle, for instance a screw-type compressor or vacuum pump, such that the gas current is guided into the silencer through an entrance and out of it through an exit and within the silencer there is provided a branching region including an inflow channel that branches into two channel sections, a first channel section that serves as a main conduit to conduct the gas current further, and a second channel section that consists of a branch closed at its end. This method is distinguished by the following measures: generating and utilizing an oppositely directed impingement of the sound-related alternating flow by a reflection and/or resonance behaviour in the branch, which is oriented so that an axial preferential direction is parallel to the direction of flow in the inflow channel, in order to reduce the pulsations in the gas current. This counter-impingement owing to a reflection and/or resonance behaviour can be additionally reinforced by dissipative measures such as generating and utilizing dissipative damping events in the "neck region" of the Helmholtz resonator (which corresponds, for instance, to the above-mentioned cover element, preferably in the form of a perforated plate).

In one preferred embodiment, the gas current is additionally, in the immediate vicinity of the counter-impingement generated in the branch, in particular downstream, guided through a constriction in order to produce a stepwise impedance change.

Furthermore, the gas current leaving the branching region is preferably guided out of the branching region at a place where the reflection-related or resonance-related extinction or reduction of the pulsation is present, for example, near the plane of the inflow cross section.

In an optional embodiment of the method in accordance with the invention, the gas current downstream of the branch is guided through an auxiliary silencer or through an additional sound-absorption means, which in particular acts as an absorption silencer.

BRIEF DESCRIPTION OF THE DRAWINGS

In the following, the invention is explained in greater detail, also with regard to additional characteristics and advantages, by the description of exemplary embodiments with reference to the following drawings, wherein.

DESCRIPTION OF THE INVENTION

Figure 1:
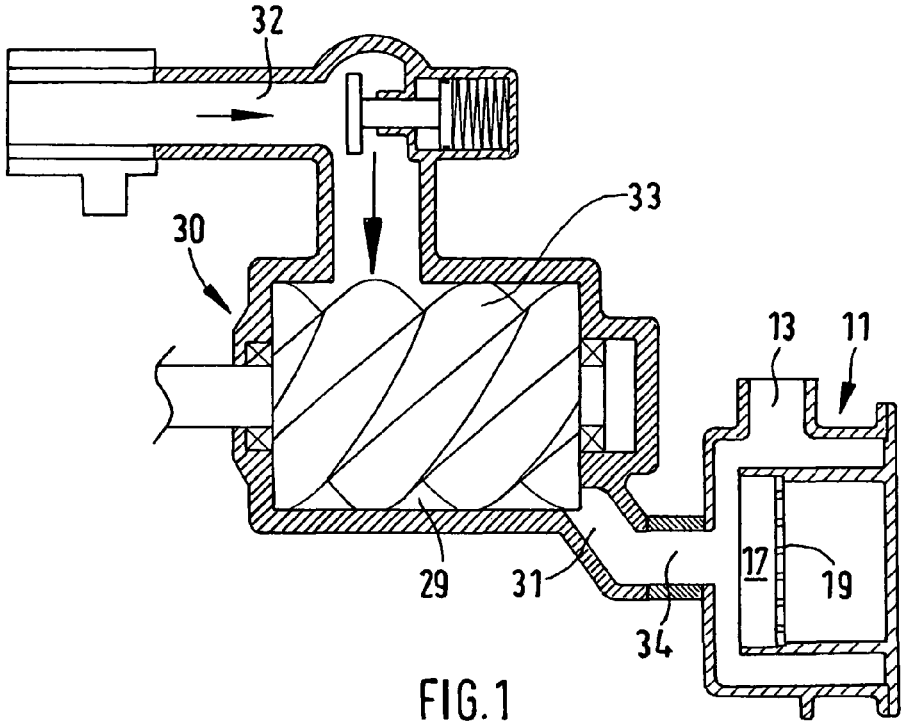
FIG. 1 is a schematic representation of a screw-type compressor, to the outlet of which a silencer according to the invention is attached.

FIG. 1 schematically illustrates a screw-type compressor 30 with an inlet channel 32 that opens into a compression chamber 29, as well as the compression chamber 29 itself with a compressor screw 33 mounted therein, and an outlet 31. Immediately outside the outlet 31 is attached, by way of a tubular piece 34, a silencer 11 in accordance with the invention. The silencer 11 is constructed so that it not only damps the sound associated with the gas current leaving the silencer 11, but also has a retroactive influence on the inflowing gas current, such that the pulsations of the gas current in the outlet 31 of the compression chamber 29 are also distinctly reduced. For this purpose, the silencer 11 should be attached either directly to the outlet 31 or in such a way that it is relatively close to the outlet 31, by means of a relatively short tube or tubular piece 34.

Figure 2:
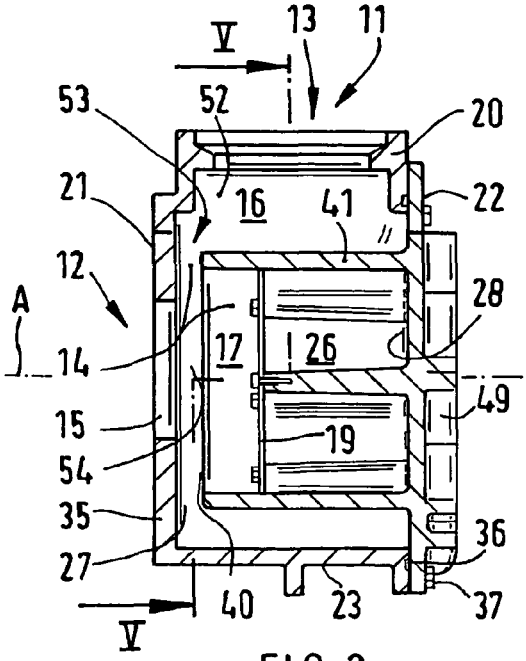
FIG. 2 shows an embodiment of a silencer in accordance with the invention in a sectional view along the line II-II in FIG. 3.
Figure 3:
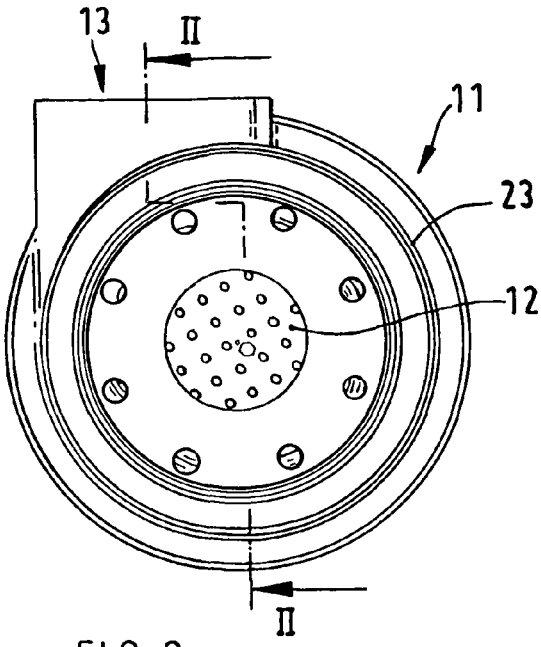
FIG. 3 shows the silencer according to FIG. 2 in plan view.
Figure 4:
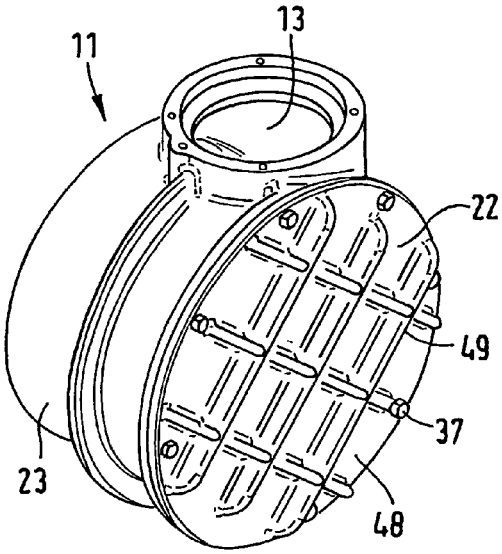
FIG. 4 shows a perspective view of the silencer according to FIGS. 2 and 3.

A specific, preferred embodiment of a silencer 11 according to the invention is explained in greater detail below, with reference to FIGS. 2 to 8. First FIG. 2 shows a sectional view of the silencer 11 along the line II-II in FIG. 3, while FIG. 3 shows a plan view of the silencer 11. The silencer 11 includes a housing 20 having substantially the shape of the flattened cylinder and including two elements that can be separated from one another, namely a housing basic body 35 and, inserted therein, a pot-shaped basic body 24. The housing 20, in the shape of a flattened cylinder, forms two end surfaces 21, 22 between which is disposed a jacket surface 23. At the center of a first, substantially circular end surface 21, there is an entrance 12 in the form of an opening for the inflowing gas current, which is oriented at a right angle to the plane of the opening of the entrance 12 in the first end surface 21. In the first end surface 21 is an opening in the jacket surface 23 of the housing 20, which defines an exit 13. The exit 13 can in principle be oriented as desired in the jacket surface, preferably also tangentially or in a "slanted axial" position.

Between the entrance 12 and exit 13, within the housing 20 of the silencer 11, a branching region 14 for gas flow is formed, the branching region 14 being defined by an inflow channel 15, a branch 17 and a main conduit 16, through which the gas is conducted further. The inflow channel 15 and main conduit 16 in the present embodiment of the silencer 11 are designed to the be extremely short and are continuous with the respective conduits to which they are attached. The branch 17, in contrast, is completely enclosed within the housing 20 of the silencer 11, and in the present case is formed by the above-mentioned pot-shaped basic body 24. The pot-shaped basic body 24 in the present embodiment is inserted (cf. also FIG. 6) into the housing basic body 35 from a side opposite the first end surface 21.

The two-part housing 20 in the form of a flattened cylinder thus includes both the housing basic body 35, which here consists of the jacket surface 23 as well as the first end surface 21, and also the pot-shaped basic body 24, which constitutes the branch 17 situated in the interior of the housing 20 and simultaneously, in the present embodiment, the second surface 22, which closes off the housing 20 in the form of an end plate 48 provided with rib structures 49.

Between the housing basic body 35 and the pot-shaped basic body 24, there can also be a circumferential sealing element 36, which functions as a gasket between the two elements, of which the housing 20, shaped essentially as a flattened cylinder is composed. The pot-shaped basic body 24, which constitutes the branch 17, can be permanently connected to the housing basic body 35, for instance welded or soldered thereto. However, a releasable connection is preferred, such as in particular a connection by way of a plurality of screws 37 that engage internally threaded bores 38 distributed over a flange surface 39 of the housing basic body 35.

The branch 17 formed by the pot-shaped basic body 24 is basically cylindrical in the embodiment preferred here, like the housing 20, and includes an opening 40 directed towards the entrance 12 so that the gas current coming from the inflow channel 15 impinges on the opening 40, and hence the branch 17, frontally. The branch 17, i.e., the pot-shaped basic body 24 in the present embodiment, is bounded by a cylindrical chamber wall 41. At the end opposite the opening 40 there is a closing surface 28. In the present embodiment the closing surface 28 is provided by an inner surface of the end plate 48, so that the end plate 48 simultaneously forms part of the outer wall of the housing 20 and also the closing surface 28, as part of the branch 17.

Finally, within the chamber wall 41 there is disposed a cover element 19, which occupies the entire cross section of the branch 17 and is set back from the opening 40 of the branch 17, towards the closing surface 28. This cover element 19 is provided with a plurality of openings 18 (cf. FIGS. 3, 5 and 6). The cover element 19 can in particular be constructed as a perforated plate.

The cover element 19 is fixed to columnar projections 42 to 45 by means of screws 46, which engage the internally threaded bores 47 within the columnar projections 42 to 45. The latter consist of a first kind of columnar projections 42 to 44, disposed on the inside of the chamber wall 41, and in addition a central columnar projection 45, which is spaced apart from the chamber wall 41 and projects above the closing surface 28 in its middle region. An axial adjustment of the position of the cover element 19 can be readily accomplished by different processing of the projections 42 to 45, in particular by procedures that remove their material.

Within the branch 17, preferably on the side of the cover element 19 that faces towards the closing surface 28, in one optional embodiment an absorbent material can be used as packing (e.g., a mineral-wool packing, a sintered body of metal or ceramic, an open-pored metal foam, a ceramic foam or the like).

Figure 7:
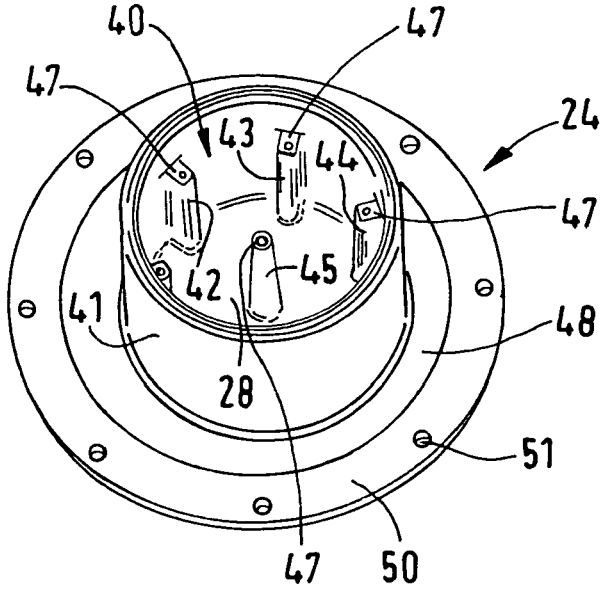
FIG. 7 shows a perspective view of a pot-shaped basic body as component of the silencer according to FIGS. 2 to 6.

In FIG. 7 the pot-shaped basic body is shown in perspective. One component of the pot-shaped basic body is the end plate 48, which simultaneously defines the end surface 22 of the housing 20 and which is provided with rib structures 49 to increase its resistance to distortion. Integrally moulded to the end plate 48 is the chamber wall 41, the lateral boundary of the branch 17 which forms a resonator chamber 26.

Figure 8:
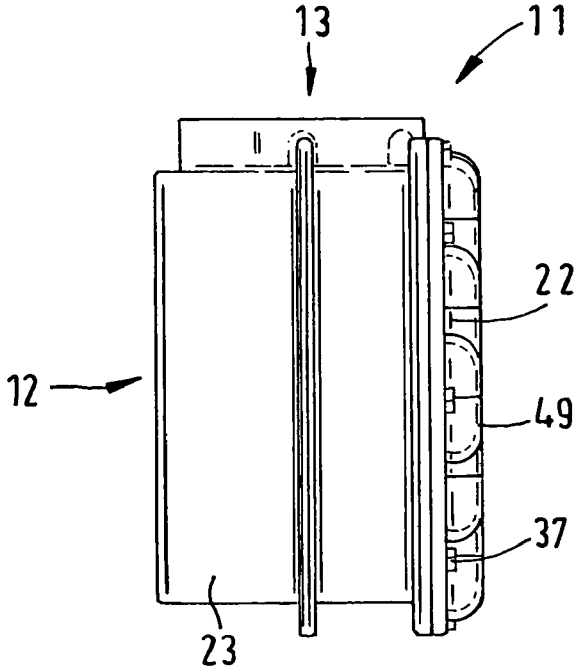
FIG. 8 shows a side view of the silencer according to FIGS. 2 to 7.

At its periphery, on the side that faces the chamber wall 41, the end plate 48 further includes a flange surface 50 with bores 51, each of which is matched to the flange surface 39 as well as the internally threaded bores 38 on the housing basic body 35. FIG. 8 also shows the silencer 11, in this case as seen from the side when fully assembled.

The pot-shaped basic body 24 is preferably positioned within the housing in such a way that its chamber wall 41 presents the least possible obstacle to outward movement of the gas through the main conduit 16, and in particular through the exit 13. For this purpose the gas current should be guided as nearly as possible tangentially or axially along the chamber wall 41, so that there are no reflecting planes for standing waves in attached pipelines.

Figure 5:
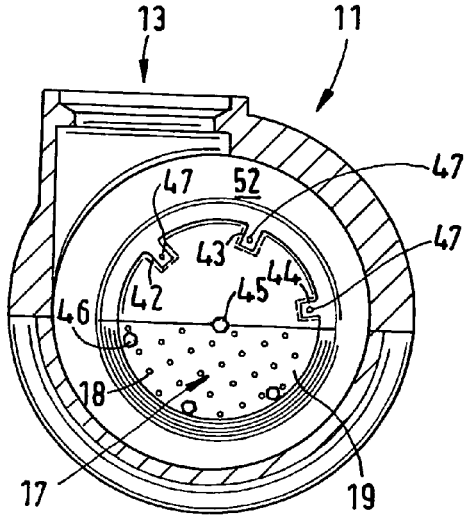
FIG. 5 shows a sectional view of the silencer along the line V-V in FIG. 2.
Figure 6:
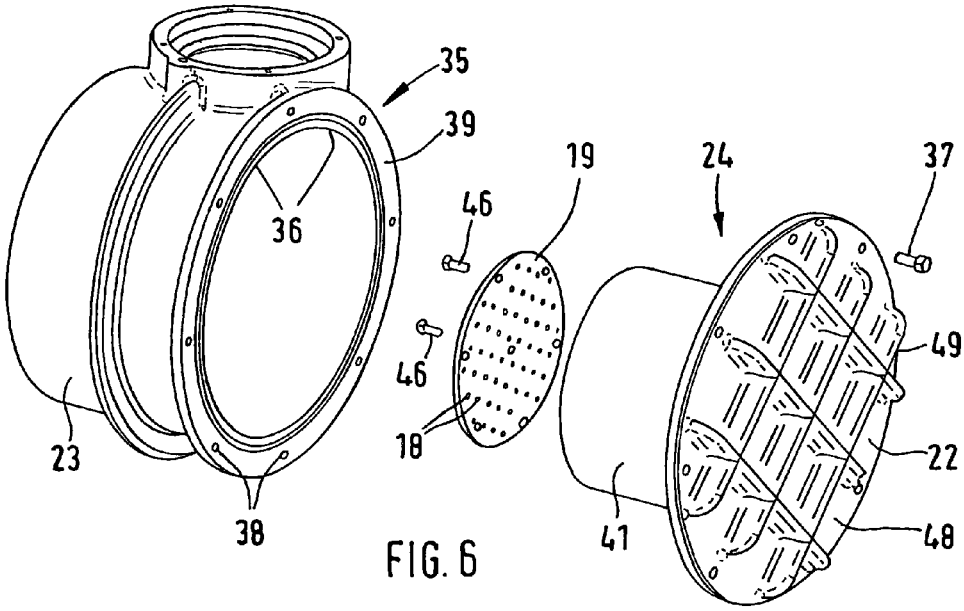
FIG. 6 shows an exploded view of the silencer according to FIGS. 2 to 5.

As is evident in particular from FIG. 5, the branch 17 bounded by the chamber wall 41 is therefore positioned coaxially, but at the same time slightly eccentrically within the housing 20, such that an annular space 52 remaining between the inside wall of the housing basic body 35 and the chamber wall 41 has a cross section that expands towards the exit 13.

The gas current flowing into the silencer 11 through the entrance 12 impinges frontally on the branch 17, which causes an effective damping of the sound-related alternating flow. The main current is thereby deflected and passes through a constriction 27, here formed as an annular gap 53, between the end face of the chamber wall 41 and the inside of the housing basic body 35 associated with the entrance 12, and then flows toward the exit 13 through the annular space 52, and subsequently emerges from the silencer 11. The annular gap 53 lies substantially in the plane of the inflow channel 15, in which reflection-related and resonance-related extinction or reduction of the pulsation prevails. In this regard, a sub-volume 54 is formed by the end face of the chamber wall 41, the cover element 19 of the branch 17, the annular gap 53, the entrance 12 and associated sections of the inside wall of the housing basic body 35. The direction of flow through the annular gap 53 over the entire extent of the annular gap 53 is substantially perpendicular to the direction of flow in the entrance 12. Thus, according to the present embodiment, within the annular gap 53 the current is diverted by 90°. The constriction 27 defined by the annular gap 53, brings about a stepwise impedance change for the gas current on which sound-related alternating flow impinges.

The branch 17 forming a resonator chamber 26 is, in the sense of a Helmholtz resonator, preferably tuned to the main expulsion frequency or to a low harmonic of the main expulsion frequency of the compressor apparatus.

Figure 9:
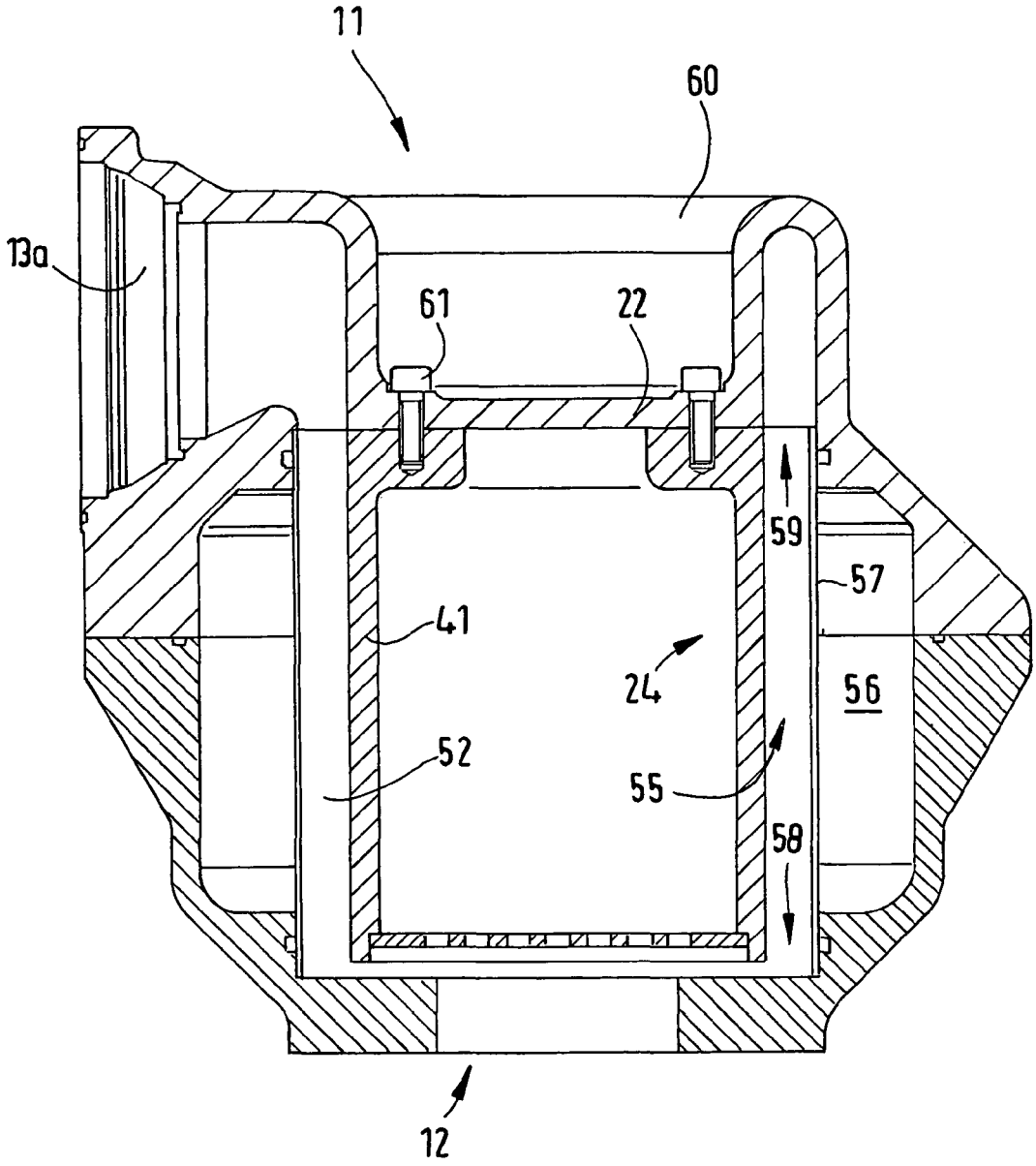
FIG. 9 shows another embodiment of a silencer according to the invention, in a sectional view.

In FIG. 9 an alternative embodiment of a silencer in accordance with the invention is illustrated in a sectional view. This embodiment is distinguished primarily by the fact that downstream of the branch there is disposed an auxiliary silencer or an additional sound-absorption means 55, which acts predominantly as an absorption sound damper and further improves the sound-damping properties of the whole arrangement. Functionally as well as structurally the branch 17, including the pot-shaped basic body 24 and cover element 19 provided with openings 18 that is set onto this basic body, is constructed so that it corresponds to the embodiment explained with reference to FIGS. 1 to 8, so that the following explanation can be limited to the configuration of the additional sound-absorption means 55.

The additional sound-absorption means 55 includes an annular space 52 which is cylindrical, concentrically enclosing the pot-shaped basic body 24, and which in its middle section is expanded by an expansion 56 that extends radially outward. The gas current flows through the constriction 27 already explained with reference to FIGS. 2 to 8, passing from the branch 17 into the annular space 52 at a first end 58 thereof, and then is guided along the outside of the chamber wall 41 of the pot-shaped basic body 24 through one or more openings to a second end 59 opposite the first end 58, and on to an exit 13*a*. The additional sound-absorption means 55 thus includes a first end 58 that faces towards the constriction 27 or itself constitutes the constriction 27, as well as a second end 59 opposite thereto, at which the gas current is guided towards the exit 13*a*. Between the first end 58 the second end 59 is disposed the above-mentioned radial expansion 56, which in the present embodiment is covered by a cover 57 that is permeable to the current but presents a resistance to flow. The current-permeable cover 57 can for example be made of a fine-meshed woven wire fabric, of sintered material or of another porous or perforated material. The current-permeable cover 57 and the radial expansion 56 of the annular space 52 together form a "perforated absorber" known per se, the acoustic properties of which—as is known per se—are determined by, among other things, the thickness of the tube wall, its resistance to flow (i.e. the size of its holes and pores and the proportion of their surface area) and the radial extent of the expansion 56 of the annular space 52.

The effectiveness of such a perforated absorber results in turn from mechanisms of reflection at its back wall (in this case, the wall bounding the expansion 56 within the annular space 52) and subsequent extinction at the current-permeable cover 57, resonance effects, dissipative current losses associated with the acoustic alternating flow through this current-permeable cover 57, etc.

Alternatively, in order to influence the absorption properties, the expansion 56 of the annular space 52 can be filled with damping materials such as mineral wool or fibrous materials, etc. In another, alternative embodiment the expansion 56 of the annular space can be filled completely or partially with another suitable sound-absorbing material (e.g. sinter material, open-pored metal foam, open-pored ceramic, etc.), in which case—if the material involved is sufficiently resistant to deformation—depending on the desired acoustic tuning the current-permeable cover 57 can also be eliminated, i.e., be functionally implemented by the sound-absorbing filler itself.

A substantial advantage in using the design that does not require filling materials, in particular fibrous or open-pored materials, in the expansion 56 of the annular space, so that the space within the expansion covered by the current-permeable cover 57 is empty, resides in the fact that there is no possibility for the escape of materials, in particular fibres or fragments, as a result of shattering by pulsations.

Although the exit 13 can in principle be as described with reference to FIGS. 2 to 8 even when the optional additional sound-absorption means 55 is provided as detailed above, in that case only a part of the annular space 52, which in some cases is provided with an expansion 56, could function as an absorption damper or additional sound-absorption means 55. Therefore it is considered useful to provide a modified exit 13*a*, as explained with reference to FIG. 9, which is disposed at or in relation to the entrance 12 behind the second end surface 22. For this purpose the (second) end surface 22 according to the embodiment shown in FIGS. 2 to 8 could be provided with openings in the region of the annular space 52, so that the gas current can pass through the (second) end surface 22 into the exit 13*a*. Alternatively, the radial extent of the (second) end surface 22 can be shortened, so that the gas current can flow freely from the second end 59 of the additional sound-absorption means 55 into an exit housing 60 that forms the exit 13*a*. The exit housing 60 is attached to the (second) end surface 22 of the pot-shaped basic body 24 by means of bolts 61.

The arrangement of the additional sound-absorption means 55 is, on one hand, structurally such as to simplify conversion, while on the other hand it is particularly effective acoustically. The latter results from the following relationships.

The silencer as a whole should have a pressure loss that is as small as possible. Therefore the flow velocities must be limited; that is, i.e., certain flow cross sections are required. The flow cross section in the annular space 52, including the expansion 56, has a relatively large peripheral surface, for instance in comparison to a pipe having the same flow cross section and assuming equal length. This large surface is formed by the current-permeable cover 57 of the additional sound-absorption means 55.

The channel damping of an absorption sound damper is—to a first approximation—proportional to the quotient of the absorbing surface area and the free cross section for flow. Because the annular space 52, as explained above, has a relatively large peripheral surface in relation to its flow cross section, the prerequisites for effectiveness of the additional sound-absorption means 55 are well met.

The preferred silencer concretely described here is distinguished by a number of properties that are favorable for use in a compressor. First, the silencer has a very broadband action and achieves good damping of the pulsations in the frequency range typically between 20 Hz to 10 kHz. Conventional sound-damping mechanisms with broadband action, for instance interference damping by reflection at consecutive stepwise changes in cross section (impedance steps) or damping by dissipative sound dampers (e.g., absorption or throttle dampers) are in part encumbered with considerable disadvantages for use in a compressor apparatus. Interference dampers based on impedance steps must have considerable cross-sections in order to achieve good efficacy. This makes it difficult to install them in pipelines, because of the dimensions required. Throttle dampers are ruled out because of the pressure losses.

Absorption dampers as a rule require the layers of absorbing media to have minimal thicknesses the order of $\lambda/4$, which in the lower region of the above-mentioned frequency range leads to unacceptable layer thicknesses and hence volumes of the structure. Furthermore, there is a risk that the absorbing materials (e.g., mineral wool, porous structures) will be shattered by the pulsations and carried out of the damper. Another problem is the lack of thermal stability of some absorbing materials.

The silencer described with reference to FIGS. 2 to 8 overcomes the above disadvantages and is distinguished by a good damping behavior in the frequency range in question. Moreover, the resulting differential pressure is only slight, so that the deterioration of compressor efficacy associated with installation in a compressor apparatus is extremely slight in the case of the specific embodiment proposed here. This embodiment of the silencer is further distinguished by a compact structure, so that the silencer can be accommodated in a compressor apparatus with a space, and so that long tubes are avoided.

Another aspect is that the silencer in according to the invention in the preferred embodiment tolerates pressure, i.e., it has inherent stability. The concretely proposed structure can easily be manufactured as a pressure-bearing housing (typically loadable with at least 11 bar), because of its outer and inner contours. Furthermore, the concretely proposed structure has also proved to be highly temperature-resistant, so that gas at temperatures up to at least 250° C. can be conducted with no problems.

In a preferred, optional embodiment the silencer according to the invention is distinguished in that absorbent materials such as mineral wool are completely unnecessary.

In the specific embodiment the two-part structure of the housing makes it comparatively stiff, so that the natural frequencies are high enough that substantially no resonance is initiated by the pulsations of the gas current.

The compact overall shape of the concretely preferred silencer enables a "stiff" construction that results in high natural frequencies and intrinsic forms such that the bending wavelengths of the relevant wall sections of the external contour are smaller than the wavelengths of the airborne sound at the said natural frequencies, which results in a low degree of sound radiation.

In the concretely described embodiment sound damping is achieved by a combination of several sound-damping principles, specifically by a Helmholtz resonator with additional dissipation (flow losses in the perforated plate), a $\lambda/4$ tube, an impedance sound damper and the fact that the main current is taken from a region where pulsations are slight as a result of reflection-related and resonance-related extinction.

It cannot be determined with ultimate certainty whether the good efficacy of the described silencer demonstrated in practical trials is ascribable exclusively to the above-mentioned effects. Over wide ranges linear acoustics surely prevail within the described silencer. Furthermore, at the outlet of the compressor the mean exit velocity is a few percent of the associated sound velocity. In view of the marked nonuniformity of the expulsion process, however, the possibility that nonlinear effects are also present cannot be excluded.

Thus part of the effectiveness of the described silencer may not be ascribable only to the described mechanisms of operation, but also to breakdown of the sound-related alternating flow, i.e., the superimposed pressure-pulsation component, by a perforated plate with a very effective dissipative action, while before reaching the perforated plate the main current is diverted away from the direction in which the pulsation propagates, and nevertheless undergoes only a slight loss of pressure, because the main current does not flow through the perforated plate.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

What is claimed is:

1. A silencer, in combination with a compressor or a vacuum pump, both of which operate according to a displacement principle, and which compress a current of gas including an air current, comprising:

an entrance for the gas current that leaves an outlet of the compressor or the vacuum pump, and an exit, such that within the silencer there is provided a branching region that comprises an inflow channel from which a first channel section and a second channel section branch away, such that the first channel section is constructed as a housing which forms a main conduit to conduct the gas current further towards the exit, and the second channel section forms a closed branch;

wherein the second channel section has an axial preferential direction oriented parallel to a direction of flow of the gas current in the inflow channel, so that the gas current impinges at least substantially frontally against the second channel section, wherein the second channel section branch comprises a pot-shaped basic body which is open at a first end and closed by an end plate at an opposite end such that the gas current that impinges at least substantially frontally against the second channel section impinges on the open first end of the pot-shaped basic body and then impinges on the end plate, wherein an annular space is formed between an inside wall of the housing which forms the main conduit and an outer wall of the pot-shaped basic body, the annular space extending over substantially an entire length of the pot-shaped basic body such that the gas current in the first channel section flows through the annular space towards the exit, wherein a cover element provided with openings, is disposed at or in the second channel section so as to cover an internal cross section thereof, wherein the silencer comprises an auxiliary damper or an additional sound-absorption means, downstream of the second channel section; and wherein the auxiliary damper or additional sound-absorption means at least partially surrounds the second channel section.

2. The silencer according to claim 1, wherein the main conduit is constructed and oriented such that the gas current emerges from the branching region in a direction of flow perpendicular to the direction of flow of the gas current within the inflow channel.

3. The silencer according to claim 1, wherein the second channel section and inflow channel are disposed so as to be at least substantially coaxial with one another.

4. The silencer according to claim 1, wherein the second channel section is subdivided by interior walls to form sub-volumes, to each of which is allocated a sub-group of the openings in a corresponding section of the cover element, and which act as largely independent damping elements with different resonant frequencies.

5. The silencer according to claim 4, wherein the sub-volumes of the second channel section comprise closing surfaces at different distances from the inflow channel and are operative as quarter wave length resonators for different frequencies.

6. The silencer according to claim 1, wherein a damping is set by at least one of an arrangement, a size, a shape, or a number of the openings in the cover element or the thickness of the cover element.

7. The silencer according to claim 1, wherein the cover element is disposed at the first end of the second channel section that faces towards the inflow channel.

8. The silencer according to claim 1, wherein the cover element is disposed so as to be set back from the first end of the second channel section that faces towards the inflow channel.

9. The silencer according to claim 1, wherein the second channel section forms a resonator chamber.

10. The silencer according to claim 1, wherein the second channel section acts at least partially as a Helmholtz resonator.

11. The silencer according to claim 1, wherein the second channel section is operative as a quarter wave length resonator.

12. The silencer according to claim 1, wherein within the branching region, downstream of the second channel section, there is formed at least one constriction through which the gas current must pass.

13. The silencer according to claim 12, wherein the at least one constriction is directed away from the inflow channel in a direction perpendicular thereto.

14. The silencer according to claim 1, wherein the gas current emerges from the branching region in a direction of flow perpendicular to the direction of flow of the gas current in the inflow channel and leaves the branching region at a place where a reflection-related or a resonance-related extinction or reduction of a pulsation in the gas current prevails.

15. The silencer according to claim 1, wherein the silencer with the branching region is formed within the housing having substantially a shape of a flattened cylinder and comprising two end surfaces between which is disposed a jacket surface, such that the entrance is positioned at a first end surface and the exit is positioned at the jacket surface.

16. The silencer according to claim 15, wherein the second end surface of the housing is formed by the end plate of the pot-shaped basic body.

17. The silencer according to claim 1, wherein the auxiliary damper or additional sound-absorption means surrounds the second channel section completely, in a substantially concentric manner.

18. The silencer according to claim 1, wherein the annular space comprises two opposite ends, such that a first end defines an inlet and a second end comprises one or more openings through which the gas current is guided to the exit.

19. The silencer according to claim 1, wherein the annular space comprises a radial expansion, which has a cover that is permeable to a flowing current.

20. The silencer according claim 1, wherein the auxiliary damper or the additional sound-absorption means is tuned to a, higher frequency than the components of the silencer upstream of the auxiliary damper or additional sound-absorption means, so that in combination a broadband action is achieved.

21. A compressor or vacuum pump that operates according to a displacement principle, including a screw-type compressor or a screw-type vacuum pump, comprising:

a compression chamber and an outlet; and a silencer attached to the outlet, the silencer comprising:

an entrance for a gas current that leaves the screw-type compressor or the screw-type vacuum pump, and an exit, such that within the silencer there is provided a branching region that comprises an inflow channel from which two channel sections branch away, such that a first channel section is constructed as a housing which forms a main conduit to conduct the gas current further towards the exit, and a second channel section forms a branch that is closed at its end;

wherein the second channel section has an axial preferential direction oriented parallel to a direction of flow of the gas current in the inflow channel, so that the gas current impinges at least substantially frontally against the second channel section, wherein the second channel section comprises a pot-shaped basic body which is open at a first end and closed by an end plate at an opposite end such that the gas current that impinges at least substantially frontally against the second channel section impinges on the open first end of the pot-shaped basic body and then impinges on the end plate, wherein an annular space is formed between an inside wall of the housing which forms the main conduit and an outer wall of the pot-shaped basic body, the annular space extending over substantially an entire length of the pot-shaped basic body such that the gas current in the first channel section flows through the annular space towards the exit, wherein a cover element provided with openings, is disposed at or in the second channel section so as to cover its internal cross section, wherein the silencer comprises an auxiliary damper or an additional sound-absorption means, downstream of the second channel section; and wherein the auxiliary damper or additional sound-absorption means at least partially surrounds the second channel section branch.

22. The silencer according to claim 1, wherein the pot-shaped basic body further comprises a cylindrical chamber wall.

23. The compressor or vacuum pump according to claim 21, wherein the pot-shaped basic body further comprises a cylindrical chamber wall.

* * * * *